US008767985B2

(12) United States Patent
Riopel

(10) Patent No.: US 8,767,985 B2
(45) Date of Patent: Jul. 1, 2014

(54) AMBIOPHONIC HEADREST

(76) Inventor: Luc Riopel, Repentigny (CA)

( * ) Notice: Subject to any disclaimer, the term of this patent is extended or adjusted under 35 U.S.C. 154(b) by 550 days.

(21) Appl. No.: 13/122,041

(22) PCT Filed: Sep. 9, 2009

(86) PCT No.: PCT/CA2009/001238

§ 371 (c)(1),
(2), (4) Date: Apr. 19, 2011

(87) PCT Pub. No.: WO2010/028483

PCT Pub. Date: Mar. 18, 2010

(65) Prior Publication Data

US 2011/0235832 A1 Sep. 29, 2011

(30) Foreign Application Priority Data

Sep. 9, 2008 (CA) ..... 2639409

(51) Int. Cl.
*H04R 5/02* (2006.01)

(52) U.S. Cl.
USPC ..... 381/300; 381/333; 381/332; 381/307

(58) Field of Classification Search
USPC ..... 381/300–305, 307, 333, 27
See application file for complete search history.

(56) References Cited

U.S. PATENT DOCUMENTS 4,440,443 A * 4/1984 Nordskog ..... 297/397
4,991,222 A 2/1991 Nixdorf
7,684,577 B2 * 3/2010 Arai et al. ..... 381/302
7,899,198 B2 * 3/2011 Holmi et al. ..... 381/302
8,194,898 B2 * 6/2012 Yokota ..... 381/310
8,199,940 B2 * 6/2012 Yokota ..... 381/301

FOREIGN PATENT DOCUMENTS

| | | |
|---|---|---|
| CA | 2219518 | 6/1999 |
| CA | 2219518 A1 | 6/1999 |
| CN | 2545782 Y | 4/2003 |
| CN | 2857681 Y | 1/2007 |
| EP | 1 395 081 | 3/2004 |
| JP | 2002-191469 | 7/2002 |
| JP | 2005-27019 | 1/2005 |

OTHER PUBLICATIONS

Written Opinion issued for PCT/CA2009/001238 on Jan. 7, 2010.
International Search Report issued for PCT/CA2009/001238 on Jan. 7, 2010.

* cited by examiner

*Primary Examiner* — Davetta W Goins
*Assistant Examiner* — Oyesola C Ojo
(74) *Attorney, Agent, or Firm* — Brouillette & Partners; Francois Cartier; Robert Brouillette

(57) ABSTRACT

A headrest provided with several loudspeakers which normally reproduce an ambiophonic sound experience. The headrest generally includes a central section provided with at least one loudspeaker, one side section provided with at least one loudspeaker and a second side section provided with at least one loudspeaker. The side sections are arranged on either side of the center section, and extend substantially perpendicularly towards the top relative to the center section. The headrest is arranged in a way so it can be connected to an audio signal source capable of generating several different audio signals.

11 Claims, 8 Drawing Sheets

AMBIOPHONIC HEADREST

REFERENCE TO PARENT APPLICATIONS

This patent application claims priority from Canadian patent application n° 2,639,409, titled "Home theater cushion", filed Sep. 9, 2008 at the Canadian Intellectual Property Office.

FIELD OF THE INVENTION

The present invention relates essentially to the field of ambiophonics and "home theater" systems. The present invention also relates to the field of headrests and cushions which include loudspeakers.

BACKGROUND OF THE INVENTION

The purpose of a home theatre system is to reproduce a sound environment similar to that of a movie theater, that is to say, to reproduce a sense of depth due to the way the sounds are emitted. There are a number of techniques to achieve this result. These techniques are based on the presence of several loudspeakers placed around the room.

Notations such as "2.1", "5.1", "6.1", "7.1" identify the number of loudspeakers used to reproduce the audio sequence. A "7.1" system, describes an eight channel sound reproduction system, of seven loudspeakers and bass and sub-bass loudspeaker commonly known as a "subwoofer" (the "0.1"). The seven loudspeakers are arranged as follows: the two front loudspeakers are used to produce ambient sound and music, the center loudspeaker, placed front is used to produce dialogue, the two side loudspeakers and the two rear loudspeakers are used to produce ambiophonic sound effects ("surround sound"). Meanwhile, the subwoofer is used to produce bass and sub-bass sound. A Dolby™ Surround 7.1 system is an example of this type of home theater system.

The home theater system normally includes an amplifier (Stereo, Dolby™ Digital, LC Concept, Digital Theater System (DTS), Sony Dynamic Digital Sound (SDDS), Dolby™ Pro Logic, Dolby™ Pro Logic 2, etc.). The image source may be, for example, a digital television satellite receiver, a digital terrestrial television ("DTT") receiver, Video Cassette Player (VHS (Video Home System), SVHS (Super VHS) or digital hard disk drive, etc.), a CD player (Compact Disc), a DVD player (Digital Video Disc) (standard, Blu-ray, etc.) DIVX™ player, a multimedia personal computer or HTPC (Home Theater Personal Computer), a high definition movie player, game console, etc.

Images can be displayed on an HDTV, plasma screen, LCD (Liquid Crystal Display) screen, video projector, rear projection screen, etc.

Various technologies have been developed over the years to produce a home theater sound environment.

Dolby™ Surround Prologic ("DPL") processing technology was invented by Jim Fosgate then sold to Dolby™ Laboratories. This was the first processing technology to give real depth to the soundscape. Sound is split into four channels: front left, center, right front and two back surround speakers, one left and one right, the surround speakers are identical.

The Dolby™ Digital ("DD") processing technology was invented by Dolby™ Laboratories. This processing technology splits the sound into six channels (5+1): front left, center, front right, back left, back right and a channel for the sub-bass (to a subwoofer). The rear channels, or surrounds, are different and reproduce the entire sound spectrum.

The Digital Theater System ("DTS") technology from Digital Theater Systems Inc., distributes the sound via six channels (5+1) the same as Dolby™ Digital, but the sound is less compressed and digital processing is different.

Dolby™ Surround Prologic I ("DPL-1") is an improved version of Dolby™ Surround. Four channels are recreated from a stereo source. A center channel is added. DPL-I limits high frequencies in the surround channel to 9,000 hertz.

Dolby™ Surround Prologic II ("DPL-II") processing technology was invented by Jim Fosgate then sold to Dolby™ Laboratories. This processing technology uses the same principles as DD and DTS but with different signal processing (two channels only).

Dolby™ Surround processing technology extracts three channels from two stereo channels: the front right, front left and rear surround channel are split across two loudspeakers which reproduce the same sound.

Dolby™ Surround Prologic II technology provides two additional channels to Dolby™ Surround Prologic: two different surround channels and a subwoofer channel. In addition to this, the surround channels broadcast the entire bandwidth, with no limitation at high frequencies.

Dolby™ Digital and DTS are developed by different laboratories and do not use the same algorithms or the same compression ratios. DTS uses a lower compression ratio than Dolby™ Digital.

Other formats have emerged alongside high definition (HD) technology, such as Dolby™ Digital Plus and DTS HD.

All the loudspeakers mentioned above serve a specific purpose. The two front loudspeakers reproduce the music and ambient sound, the center loudspeaker is for dialogue and the two surround (or lateral) loudspeakers give the effect of depth.

When five loudspeakers and a subwoofer are used (in the "5.1" version), Dolby™ Laboratories suggest that the back loudspeakers (left and right) are directed towards the listening position. In theory, the subwoofer can be placed anywhere, as the sub-bass sound waves it produces cannot be located by the human ear.

Technologies using seven loudspeakers and a subwoofer involve a doubling of the back center channel. These back center channels correspond to the two "back surround" outputs, the back left and right loudspeakers are simply the left and right "surround" positions.

Despite technological advances in the field of home theater systems, the fact remains that these systems generally require a room of adequate size to be able to position the loudspeakers correctly, a room that is not always available. Moreover, for current home theater systems, it is usually necessary to adjust the sound to quite a high level to reproduce all sound effects. However, the noise level required can become annoying when the room in which the system is installed is close to the neighbors. A new system mitigating these disadvantages would therefore be useful.

SUMMARY OF THE INVENTION

The present invention provides a headrest comprising a number of loudspeakers capable of reproducing a home theater environment.

The ambiophonic headrest can be installed on a chair, a bed, or on a wall.

The ambiophonic headrest includes at least three and preferably up to eight loudspeakers and a subwoofer or sub-bass loudspeaker. The headrest can reproduce a surround sound environment as generated by a stereo system, Dolby™ 5.1, Dolby™ 6.1 or Dolby™ 7.1 systems, or systems using multiple loudspeakers to produce a sound effect.

The ambiophonic headrest can include more loudspeakers, or be adapted to a technology other than Dolby™ to reproduce a sound environment.

The ambiophonic headrest allows the user to benefit fully from the capabilities of home theater systems without disturbing their neighbors.

By preference the ambiophonic headrest is portable to allow its user to use it in different locations and/or with different systems (eg. home theater system, games console, computer, etc.).

The features of the present invention which are considered new and inventive will be described in greater detail in the claims set out below.

DESCRIPTION OF DRAWINGS

The benefits, objectives and features of the present invention will be more easily observed by referring to the following detailed description to be made using diagrams in which.

DETAILED DESCRIPTION OF THE PREFERRED EMBODIMENT

An ambiophonic headrest is described below. Although the invention will be described using examples of one or more preferred embodiments, it is important to understand that these preferred embodiments are used to illustrate the invention and not to limit its scope.

Figure 1:
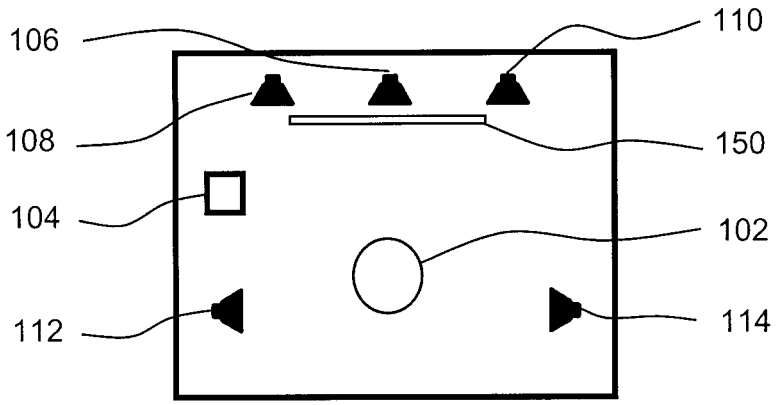
FIG. 1 is a representation of a Dolby™ Digital 5.1 system.
Figure 2:
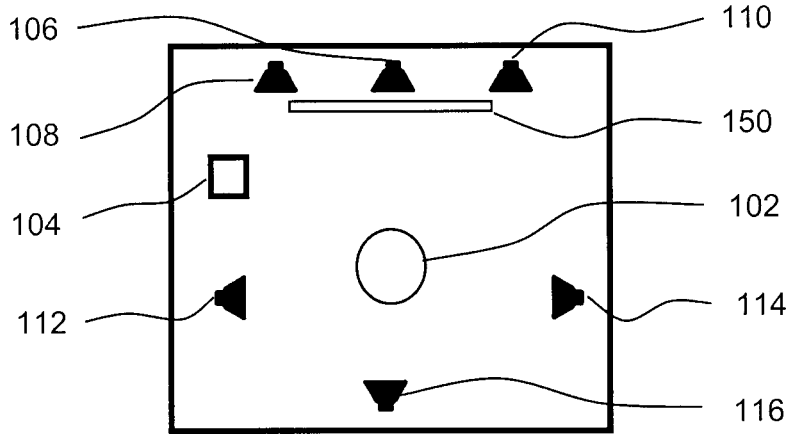
FIG. 2 is a representation of a Dolby™ Digital 6.1 system.
Figure 3:
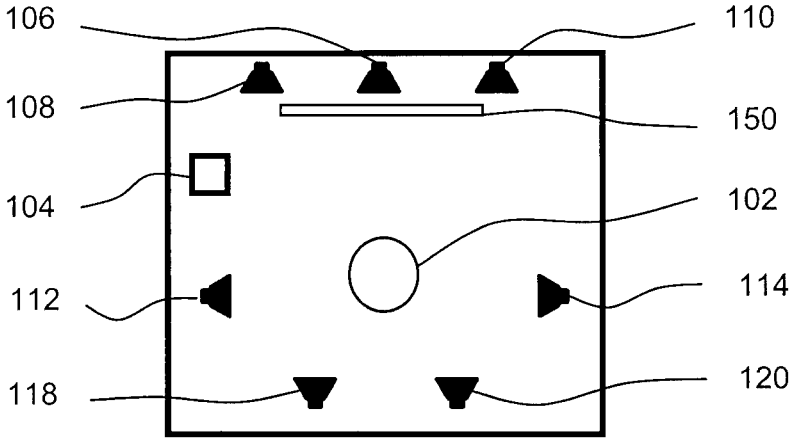
FIG. 3 is a representation of a Dolby™ Digital 7.1 system.

FIGS. 1-3 show the loudspeaker arrangement for Dolby™ Digital 5.1, 6.1 and 7.1 installations respectively. The loudspeakers are positioned on either side of the listening position 102. The user is sitting in front of the image produced by a television 150 (or other image projection system). The subwoofer 104 has no preferred position and is placed to the front left side for illustrative purposes.

The installation of a 5.1 system shown in FIG. 1 includes a front left loudspeaker 108, a right front loudspeaker 110, a center loudspeaker 106 placed at the front, a left side loudspeaker 112 and a right side loudspeaker 114.

Installation of a 6.1 system shown in FIG. 2 includes the same loudspeakers as those of the 5.1 system with the addition of a back loudspeaker 116. The installation of a 7.1 system also includes the same loudspeakers as those of the 5.1 system, with the addition of a back left loudspeaker 118 and a back right loudspeaker 120.

As shown in FIGS. 4A, 5, 6 and 8, a preferred embodiment of the ambiophonic headrest 200 by preference includes eight loudspeakers, a back right loudspeaker 220, a back left loudspeaker 218, a right side loudspeaker 214, a left side loudspeaker 212, a front right loudspeaker 210, a front left loudspeaker 208, a center right loudspeaker 205, a center left loudspeaker 207 and a subwoofer 204. It should be noted that the signal normally intended for the center loudspeaker is split and sent to the center right 205 and left 207 loudspeakers. These center right and left loudspeakers 205 and 207 therefore reproduce the same audio signal.

The headrest 200 normally includes a back panel, or central portion, 230 to support the user's head 202 and to which the right 220 and left 218 back loudspeakers and preferably the subwoofer 204 are fixed to. The headrest 200 includes an extension or right side section 232 and an extension or left side section 234 where the side, front and center loudspeakers are placed. The left 234 and right 232 extensions come out from the sides of the back panel 230 preferably at right angles but it is possible that these extensions can be at an angle smaller or greater than 90° from the back panel. The left 234 and right 232 extensions can be mounted on the back panel 230 or can be made as an integral part of the back panel 230.

When a user uses the headrest 200, he rests its head on the central section 230. The distance between the right 234 and left 232 extensions is generally arranged to receive the head of a user and leave a space between the head of the user and the internal walls of the left 234 and right 232 extensions (see FIG. 4B).

Figure 4A:
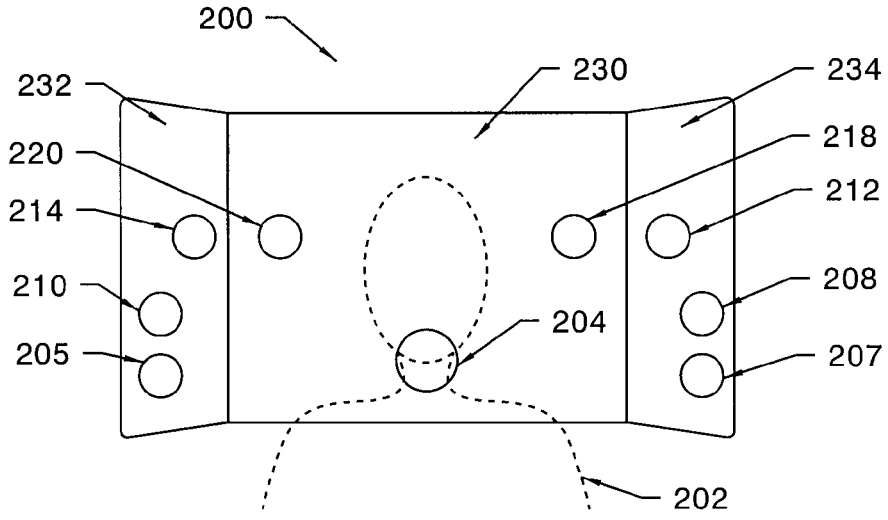
FIG. 4A is an extended schematic view of an ambiophonic headrest.
Figure 4B:
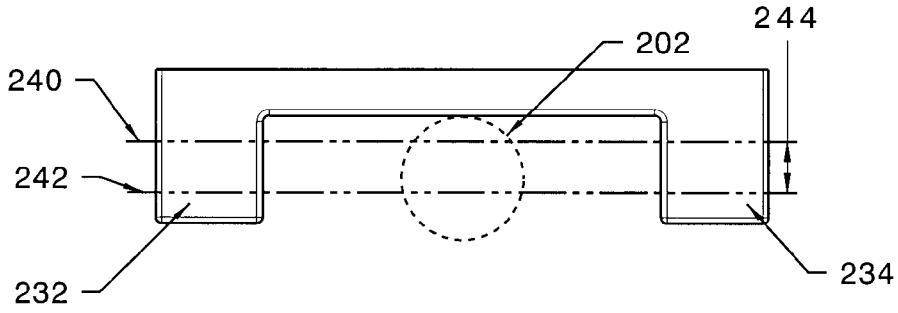
FIG. 4B is a top view showing the arrangement of the loudspeakers in the extensions of the ambiophonic headrest from FIG. 4A.
Figure 5:
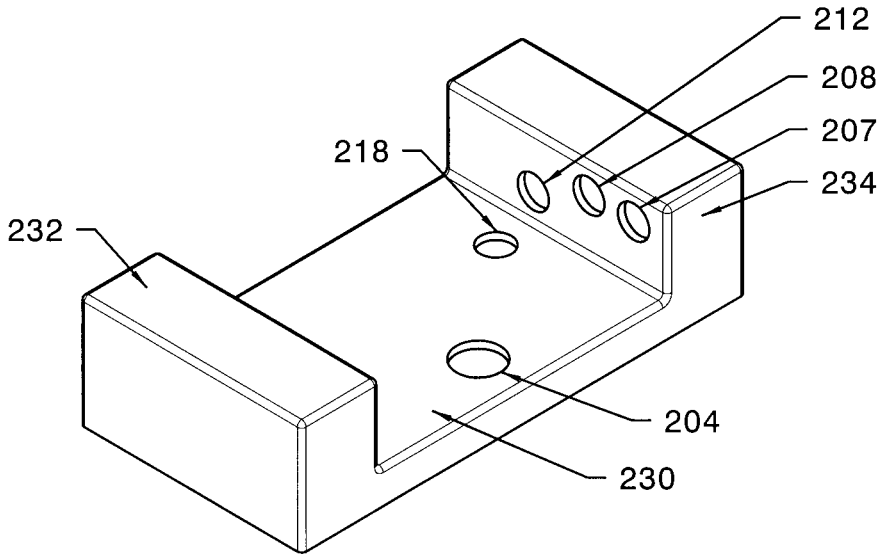
FIG. 5 is an isometric view of a first embodiment of the ambiophonic headrest.
Figure 6:
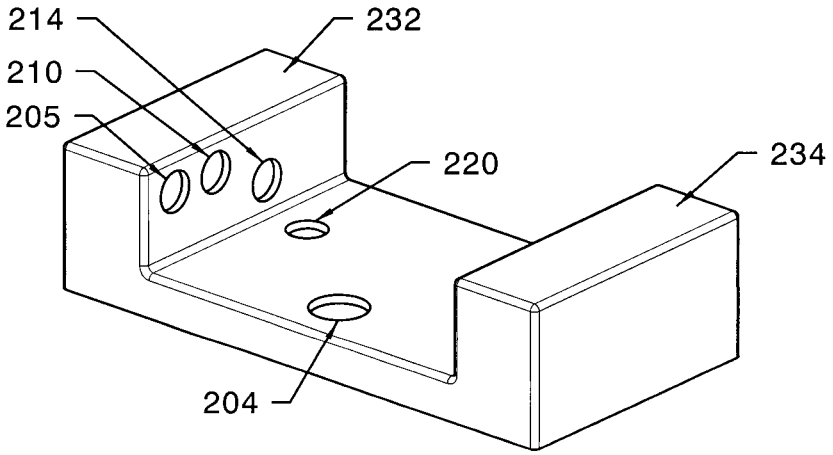
FIG. 6 is another isometric view of the embodiment shown in FIG. 5.
Figure 7:
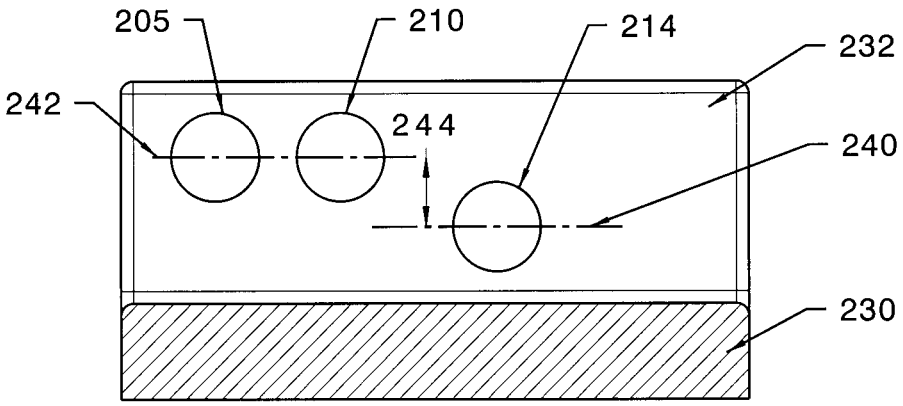
FIG. 7 is a sectional view of the embodiment shown in FIG. 5.
Figure 8:
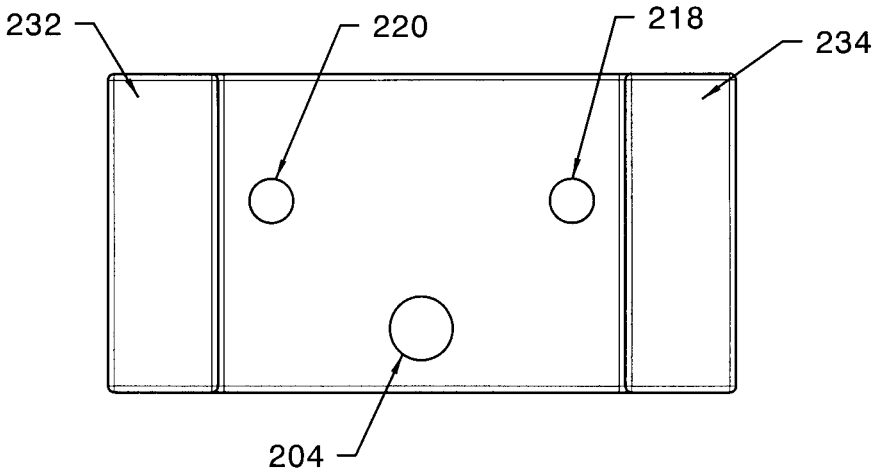
FIG. 8 is a top view of the embodiment shown in FIG. 5.

FIGS. 4B and 7 show the preferred arrangement of loudspeakers in the left and right extensions. The loudspeakers are arranged symmetrically on both sides, the arrangement will be explained for one side only for purposes of simplification. As shown in the Figures, the loudspeakers placed in the right extension 232 are not all at the same level. In particular, the side right loudspeaker 214 is closer to the back panel 230, which is lower than the center right loudspeaker 205 and the front right loudspeaker 210. There is therefore a distance 244 between axes 240 and 242 through the center of the right loudspeakers 214 and the side right loudspeaker 205 and the front right loudspeaker 210.

The distance 244 between the loudspeakers is important to reproduce the effect of depth. As discussed in the description of FIGS. 1 to 3, the back loudspeakers are normally placed behind the listening position. On the headrest, side loudspeakers 212 and 214 are positioned laterally and behind the user's ears on the inner wall of extensions 232 and 234. The direction of the sound produced by loudspeakers 212 and 214 is normally parallel to the direction of axes 240 and 242.

The front left loudspeakers 208 and 210 are positioned before the user's ears. The center right and left loudspeakers 205 and 207 are the same; they are arranged before the user 202 as in a home theater setup. As already mentioned, the center right and left loudspeakers 205 and 207, both reproduce the sound usually produced by the center loudspeaker 106 (see FIGS. 1-3).

The back left loudspeakers 218 and 220 are located behind the user, on the back panel 230. The sound is sent more or less perpendicular to the surface of the back panel 230.

The subwoofer (or bass and sub-bass loudspeaker) 204 is placed in the back panel 230. It should be noted that the subwoofer 204 can be placed in a different position to the one shown, either on the back panel 230 or on the left 234 or right 232 extensions. However, the subwoofer 204 is preferably placed on the back panel 230 so as to be located behind the head of the user 202. In doing so, the user 202 can feel the vibrations produced by the subwoofer 204, adding an extra dimension to the listening and/or viewing experience. It should also be noted that subwoofer 204 may be placed more deeply into the back panel 230 than the back loudspeakers 218 and 220.

It should be noted that the loudspeakers can be arranged on a specific angle to change the direction of the sound.

The back panel 230 and the right 232 and left 234 extensions are usually made of polymeric foam and are preferably coated with a polymeric or elastomeric membrane so as to contain the sound within the headrest 200. Moreover, the loudspeakers are preferably covered with a grid 270, shown in FIG. 10, or some similar form of protection to protect them during use.

The ambiophonic headrest 200 in its entirety is preferably covered with a cover covering the back panel 230 and the right 232 and left 234 extensions. The cover is preferably removable and made of a washable material.

Figure 9:
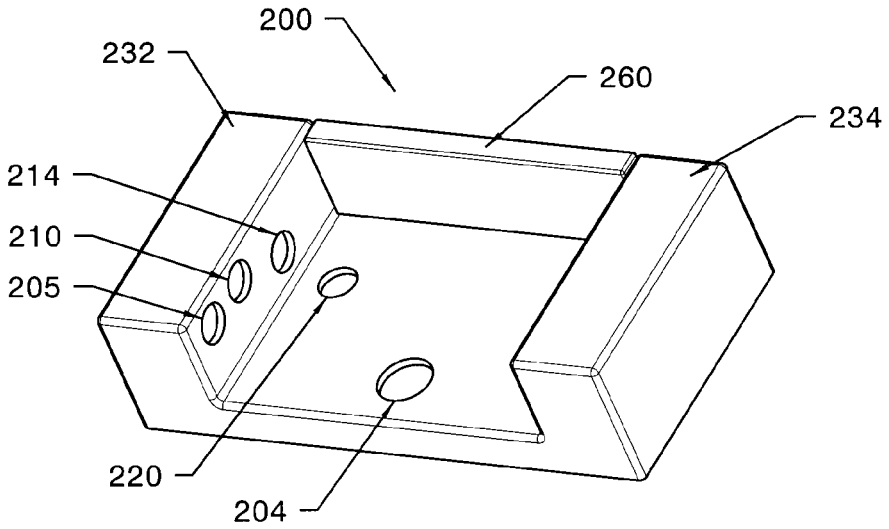
FIG. 9 is an isometric view of the embodiment shown in FIG. 5, which has an upper piece installed.
Figure 10:
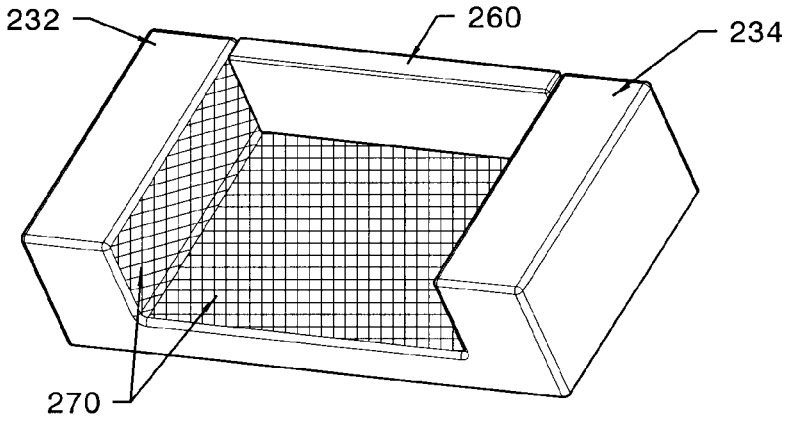
FIG. 10 is an isometric view of the embodiment shown in FIG. 8, the headrest loudspeakers are covered with a grill.

As shown in FIGS. 9 and 10, the headrest can be provided with additional removable extensions such as the extension 260 mounted behind the central panel 230 between the left 232 and right 234 extensions. Extension 260 allows, among other things, better containment of the sound from the loudspeakers. Additional extensions such as extension 260 are typically attached to the headrest 200 by Velcro® strips or other means of attachment.

Figure 11A:
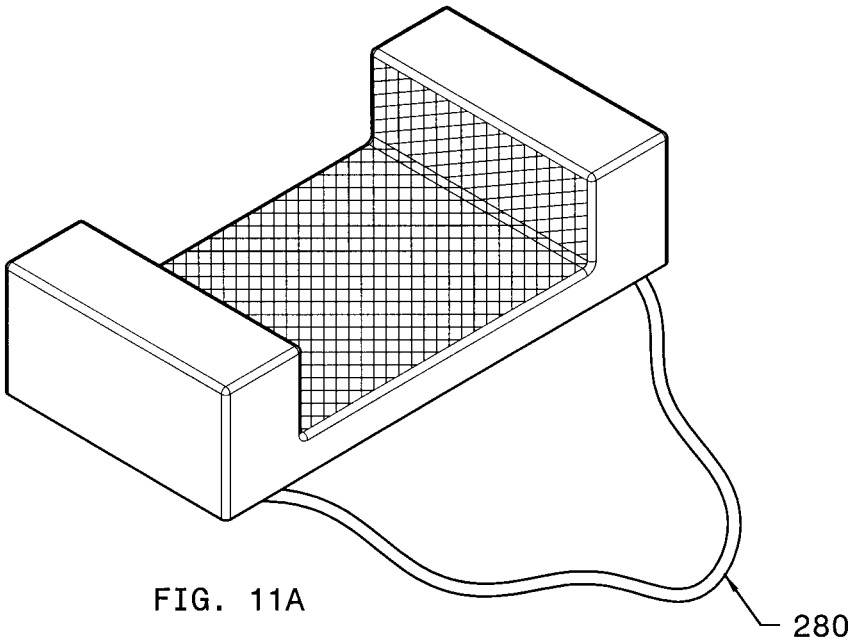
FIG. 11A is an isometric view of the embodiment shown in FIG. 5, with a strap.
Figure 11B:
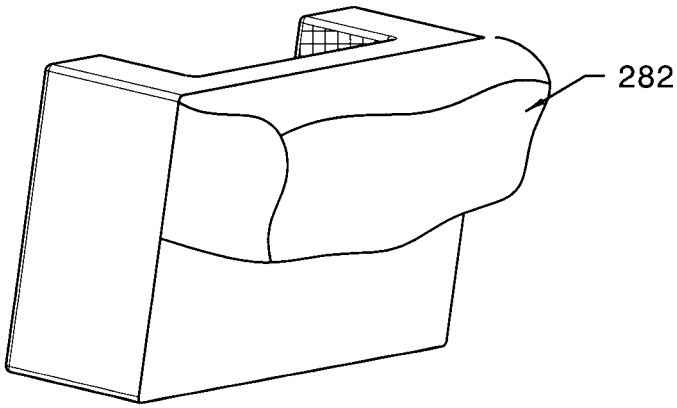
FIG. 11B is an isometric view of the embodiment shown in FIG. 5, with a protective cover.
Figure 13:
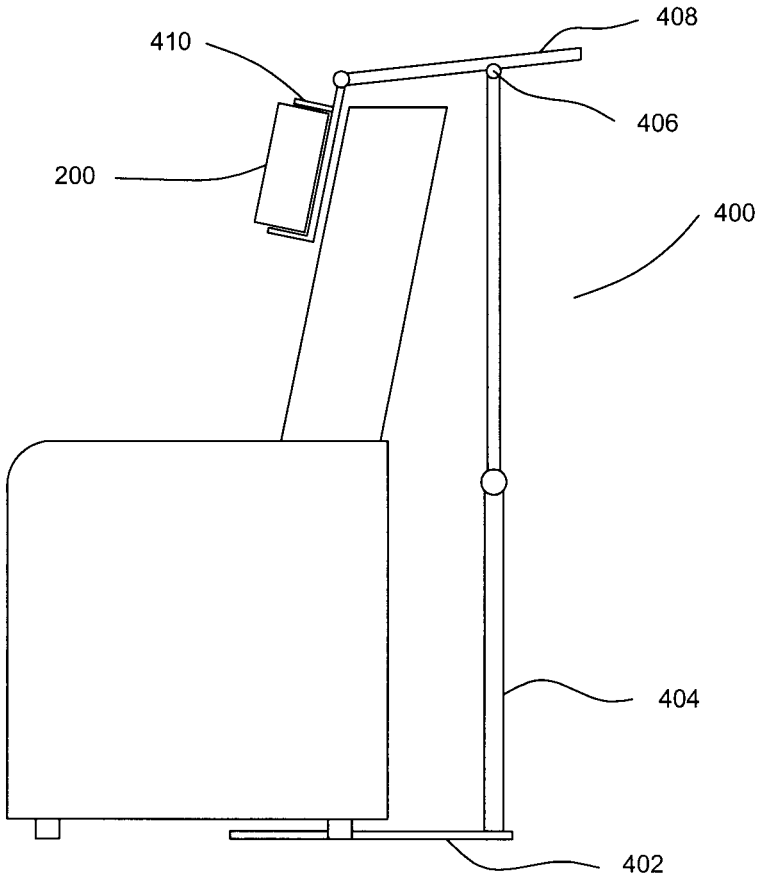
FIG. 13 is a side view of a support for the ambiophonic headrest.

The headrest can be suspended for storage or during use, from a wall hook using a strap 280 as shown in FIG. 11 or from an adjustable stand 400 as illustrated in FIG. 13. Strap 280 may also allow the cushion to be fixed to the back of an armchair or a chair. A protective cover 282 attached to the back of the ambiophonic headrest 200 can be used to install it to a chair or armchair.

The adjustable support 400 illustrated in FIG. 13 normally includes a base 402 which is fixed to a telescopic support rod 404. A pivoting arm 408 is mounted to the telescopic support rod 404 by a lockable hinge 406. Arm 408 is provided with a plate 410 (or other means of support) at one end, which can support the headrest 200.

In general, back panel 230 is made of a material such as foam to provide comfort to the user when listening to a visual sequence. The material may be fairly rigid or be offered in a variety of hardnesses to meet the needs of different users. The padding can be made of polymeric foam.

Extensions 232 and 234 may be made of the same material as the back panel if this adequately supports the loudspeakers and maintains the shape of the ambiophonic headrest 200. The extensions may also be made of a stiffer material to keep the shape of the ambiophonic headrest.

Although not shown in the Figures, the headrest 200 may be improved by the addition of a rigid skeleton where necessary to support the loudspeakers.

Figure 12:
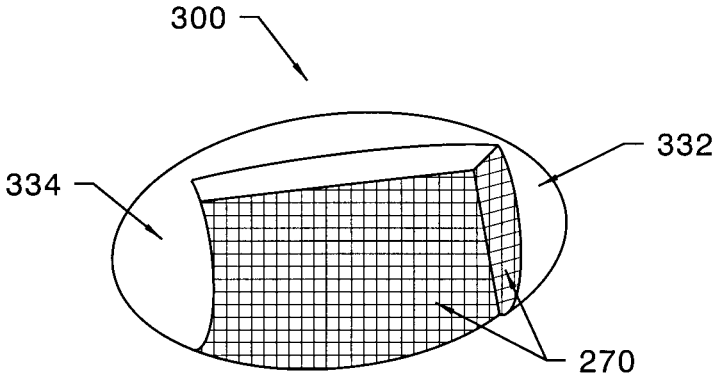
FIG. 12 is an isometric view of a second embodiment of the ambiophonic headrest.

Note that the ambiophonic headrest can be made in many shapes although they have not been illustrated in the present invention. For example, the headrest 300, shown in FIG. 12, is egg-shaped.

The person skilled in the art would understand that the loudspeakers 204 to 220 are adapted to be connected in a conventional manner, either by wires, or by a wireless interface (e.g. using a "Bluetooth" or "Wi-Fi" interface), to an audio signal source such as an amplifier connected to a DVD player or a digital receiver. Moreover, the person skilled in the art would understand that if only some of the loudspeakers are connected to an audio signal source, only some of the loudspeakers will produce sound. For example, if the preferred embodiment of the headrest 200 is connected to a Dolby™ 5.1 audio source, the side right 214 and left 212 loudspeakers will produce no sound.

Finally, the person skilled in the art would understand that the loudspeakers should normally be chosen so that they can be integrated into the back panel 230 and to the extensions 232 and 234.

Although it has been described using one or more preferred embodiments, it should be understood that the present invention can be used, employed and/or embodied in a multitude of other forms. Therefore, the following claims should be interpreted to include these forms while remaining outside the limits set by prior art.

The invention claimed is:

1. A headrest adapted to be connected to an audio signal source, where the audio signal source comprises at least eight different audio signals, the headrest comprising a center section, a first side section placed on one side of the center section and extending substantially perpendicular to the center section, a second side section placed on a second side of the center section and which extends substantially perpendicular to the center section, the center section comprises a first plurality of loudspeakers, the first side section comprises a second plurality of loudspeakers and the second side section comprises a third plurality of loudspeakers, all loudspeakers are connectable to the audio signal source, wherein the first plurality of loudspeakers in the center section comprises at least a first loudspeaker which can reproduce the first of the eight audio signals and at least a second loudspeaker which can reproduce a second of the eight audio signals, and at least a third loudspeaker that can reproduce a third of the eight audio and wherein the second plurality of loudspeakers of the first side section comprises at least a fourth loudspeaker which can reproduce a fourth of the eight audio signals, at least a fifth loudspeaker which can reproduce a fifth of the eight audio signals and at least a sixth loudspeaker which can reproduce a sixth of the eight audio signals, and wherein the third plurality of loudspeakers of the second side section comprises at least a seventh loudspeaker which can reproduce the same signal as the fourth loudspeaker, at least an eighth loudspeaker which can reproduce the seventh of the eight audio signals and at least a ninth loudspeaker which can reproduce the eighth of the eight audio signals wherein the fourth and fifth loudspeakers are placed at a first height on the first side section and the sixth loudspeaker is placed at a second height on the first side section, the second height being lower than the first height wherein the seventh and eighth loudspeakers are placed at a first height on the second side section and the ninth loudspeaker is placed at a second height on the second side section, the second height being lower than the first height.

2. The headrest of claim 1, wherein the first heights of the first and second side sections are substantially equal heights and second heights of the first and second side sections are substantially equal.

3. A headrest adapted to be connected to an audio signal source, the audio signal source comprising at least eight different audio signals, the headrest comprises front and back edges and comprises a center section, a first side section located on one side of the center section, which extends substantially perpendicular to the center section, a second side section located on a second side of the center section and which extends substantially perpendicular to the center section;

the center section comprises a first plurality of loudspeakers connectable to the audio signal source, the first side section comprises a second plurality of loudspeakers to the audio signal source and the second side section comprises a third plurality of loudspeakers connectable to the audio signal source;

the first plurality of loudspeakers comprises a first loudspeaker which can reproduce a first audio signal, a second loudspeaker which can reproduce a second audio signal, and a third loudspeaker which can reproduce a third audio signal, the first and second loudspeakers are located closer to the back edge than the third loudspeaker;

the second plurality of loudspeakers comprises a fourth loudspeaker which can reproduce a fourth audio signal, a fifth loudspeaker which can reproduce a fifth audio signal and sixth loudspeaker which can reproduce a sixth audio signal, the fourth loudspeaker being located closer to the front edge than the fifth and sixth loudspeakers, and the sixth loudspeaker is located closer to the center section than of the fourth and fifth loudspeakers;

the third plurality of loudspeakers comprises a seventh loudspeaker which can reproduce a seventh audio signal, an eighth loudspeaker which can reproduce an eighth audio signal and a ninth loudspeaker which can reproduce a ninth audio signal, the seventh loudspeaker being located closer to the front edge than the eighth and ninth loudspeakers, and the ninth loudspeaker is located closer to the center section than the seventh and eighth loudspeakers;

wherein the fourth and seventh audio signals are identical and wherein the other audio signals are different from each other.

4. The headrest of claim 3, wherein the center section and side sections are made from polymeric foam.

5. The headrest of claim 3, wherein the center section and side sections are covered with a membrane.

6. The headrest of claim 5, wherein the membrane is made of a polymeric material.

7. The headrest of claim 5, wherein the membrane is made from an elastomeric material.

8. The headrest of claim 1, wherein the center section and side sections are made from polymeric foam.

9. The headrest of claim 8, wherein the center section and side sections are covered with a membrane.

10. The headrest of claim 9, wherein the membrane is made from a polymeric material.

11. The headrest of claim 9, wherein the membrane is made from an elastomeric material.

* * * * *